US008220376B2

(12) United States Patent
Jonsson

(10) Patent No.: US 8,220,376 B2
(45) Date of Patent: Jul. 17, 2012

(54) COUNTERMASS WEAPON

(75) Inventor: Richard Jonsson, Stockholm (SE)

(73) Assignee: Saab AB, Linköping (SE)

( * ) Notice: Subject to any disclaimer, the term of this patent is extended or adjusted under 35 U.S.C. 154(b) by 285 days.

(21) Appl. No.: 12/554,051

(22) Filed: Sep. 4, 2009

(65) Prior Publication Data

US 2010/0064884 A1 Mar. 18, 2010

(30) Foreign Application Priority Data

Sep. 4, 2008 (EP) ..... 08445027

(51) Int. Cl.
*F41A 1/10* (2006.01)

(52) U.S. Cl. ..... 89/1.701; 89/1.705

(58) Field of Classification Search ..... 89/1.7, 89/1.701, 1.702, 1.705
See application file for complete search history.

(56) References Cited

U.S. PATENT DOCUMENTS

| | | | | |
|---|---|---|---|---|
| 3,405,469 | A * | 10/1968 | Marcel | 42/118 |
| 3,780,616 | A | 12/1973 | Rusbach | |
| 4,196,653 | A * | 4/1980 | Jackson | 89/136 |
| 4,672,881 | A * | 6/1987 | Betts et al. | 89/1.816 |
| 5,109,750 | A * | 5/1992 | Kayaian | 89/1.818 |
| 7,353,739 | B2 * | 4/2008 | Ax et al. | 89/1.701 |

FOREIGN PATENT DOCUMENTS

| | | | |
|---|---|---|---|
| DE | 2125149 | A1 | 12/1971 |
| DE | 37 30 158 | A1 * | 12/1990 |
| EP | 1526352 | A1 | 4/2005 |
| EP | 1705499 | A1 | 9/2006 |
| EU | 0 100 722 | A1 * | 2/1984 |
| FR | 2725268 | A | 4/1996 |

OTHER PUBLICATIONS

European Search Report—March 5, 2009, 9 pages.

* cited by examiner

*Primary Examiner* — Stephen M Johnson
(74) *Attorney, Agent, or Firm* — Venable LLP; Eric J. Franklin

(57) ABSTRACT

A countermass weapon including a launching tube open or openable in both ends. The launching tube houses a launchable unit, a countermass, a pressure chamber, a propellant charge that upon firing and combustion of the charge in cooperation with the pressure chamber and the countermass accelerates the launchable unit forwards in the tube at the same time as the countermass accelerates backwards in the tube, and a firing and supporting unit connected to the outside of the launching tube. The countermass is designed such that a forward directed recoil is obtained and the launching tube is designed to be disengageable from the firing and supporting unit during the forward directed recoil.

19 Claims, 6 Drawing Sheets

COUNTERMASS WEAPON

CROSS-REFERENCE TO RELATED APPLICATIONS

This application claims priority to European patent application 08445027.9 filed 4 Sep. 2008.

FIELD OF THE INVENTION

The present invention relates to a countermass weapon comprising a launching tube open or openable in both ends, the launching tube housing a launchable unit such as a rocket, a projectile, a shell or the like, a countermass, a pressure chamber, a propellant charge that upon firing and combustion of the charge in cooperation with the pressure chamber and the countermass accelerates the launchable unit forwards in the tube at the same time as the countermass accelerates backwards in the tube, and a firing and supporting unit connected to the outside of the launching tube.

BACKGROUND OF THE INVENTION

An example of a countermass weapon according to the above is previously known from EP patent 1 526 352. In countermass weapons of this type it is required that the recoil is on a low level. In order to keep the recoil on a low level the production is associated with an accurate control of the powder used, and narrow limits in production and mounting are required. These circumstances taken together result in high production costs.

SUMMARY OF THE INVENTION

The object of the invention is to obtain a countermass weapon that is less complicated to manufacture reducing the costs and that at the same time avoids possible recoil problems for the gunner and making the weapon safer for the user.

The object of the invention is obtain by a countermass weapon characterized in that the countermass is designed such that a forward directed recoil is obtained and that the launching tube is designed to be disengageable from the firing and supporting unit during the forward directed recoil. By combining a forward directed recoil with a disengagement of the launching tube it is ensured that the gunner only feels a low level recoil. Most of the energy of the recoil is transferred as a kinetic energy to the launching tube. The combining of a forward directed recoil with a disengagement of the launching tube results in that the launching tube slips forward and due to that there is no risk of hurting the gunner or other persons behind the gunner. Furthermore, the safety of the weapon is increased due to the fact that the arming of the weapon can be dependent on the engagement or non-engagement of the firing and supporting unit to the launching tube.

According to a favourable development of the countermass weapon the countermass is provided with indications of fractions on the surface of the countermass to obtain a forward directed recoil. By providing indications of fractions in this way a forward directed recoil of suitable strength can be accurately defined.

The launching tube can be disengaged by a mechanical connection between the launching tube and the firing and supporting unit. Other examples are disengagement by an electro mechanical connection between the launching tube and the firing and supporting unit or by a magnetical connection between the launching tube and the firing and supporting unit.

According to another favourable development the movement of a firing pin comprised in the firing and supporting unit initiates the disengagement of the launching tube. This ensures that the launching tube is secured to the firing and supporting unit until the launching unit is fired.

According to still another favourable development of the invention a link arm coupled to a trigger of the firing and supporting unit initiates the disengagement of the launching tube. This ensures that the launching tube is secured to the firing and supporting unit until the gunner activates the trigger.

According to yet another favourable embodiment of the invention a spring-pin arrangement influenced by the movement or ignition of the launchable unit is provided to initiate the disengagement of the launching tube. This ensures that the launching tube is secured to the firing and supporting unit until the launchable unit changes condition as a result of movement or ignition.

The firing and supporting unit can be given a plurality of different tasks. As particular examples it is proposed that the firing and supporting unit comprises a shoulder piece. As another particular example it is proposes that the firing and supporting unit comprises a front piece. It is also proposed that it could comprise a sighting device.

Advantageously, it is proposed that the firing and supporting unit is designed re-usable for enabling connection to a plurality of different launchable units. This makes the weapon more flexible in that the same firing and supporting unit can be used together with a plurality of launching tubes brought by the gunner. These launching tubes can be of the same type but it is also possible to connect the firing and supporting unit to launching tubes containing different launchable units thus increasing the adaption of the weapon to different scenarios.

Furthermore it is proposed that the front piece is provided with a hook releasable from the launching tube by a movement backwards. This in combination with other releasable fastening means creates a reliable fastening of the firing and supporting unit to the launching tube and at the same time facilitates the releasing of the launching tube from the firing and supporting unit.

It is also proposed that the sight is provided with a holder designed to be folded at least partly around the launching tube. This solution also facilitates the releasing process of the launching tube from the firing and supporting unit in that the launching tube can glide within the holder.

BRIEF DESCRIPTION OF THE DRAWINGS

The invention will now be described in more detail by means of exemplified embodiments with reference to the accompanying drawing in which.

DETAILED DESCRIPTION OF EMBODIMENTS OF THE INVENTION

Figure 1:
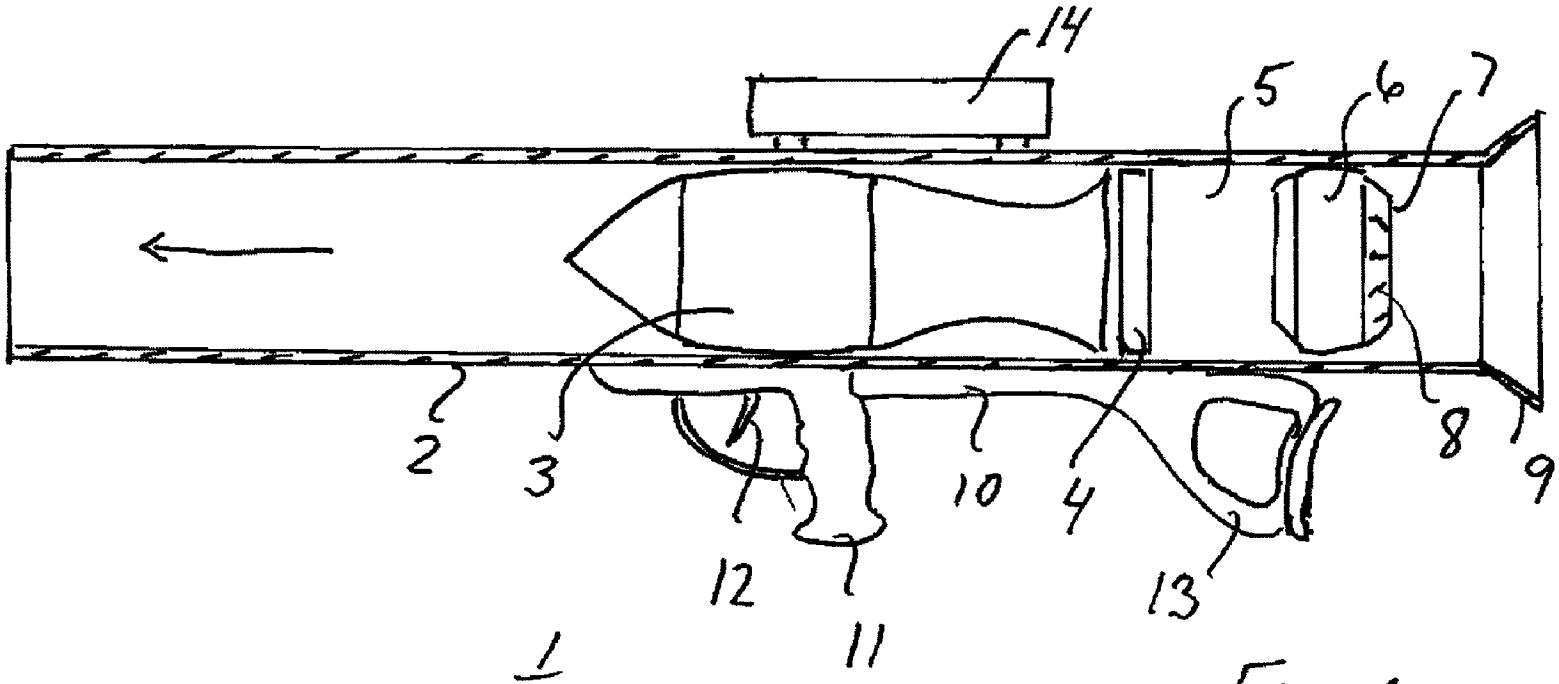
FIG. 1 in a side view and partly sectioned shows a countermass weapon according to the invention.

The countermass weapon 1 shown in FIG. 1 comprises an open launching tube 2 housing a launchable unit in the shape of a shell 3. Behind the shell 3 there is provided a propellant charge 4, a pressure chamber 5 and a countermass 6. The countermass 6 is provided with indications of fractions 7 on the surface 8 of the countermass 6 facing the rear end 9 of the launching tube 2.

The indication of fractions 7 are so designed that the desired forward acceleration of that launching tube is obtained. In order to open up the countermass 6 adequately parameters such as extension, number and position of the indications of fractions can considered. In this connection it can be referred to our U.S. Pat. No. 7,353,739 showing a countermass weapon having a countermass provided with indications of fractions.

Figure 2:
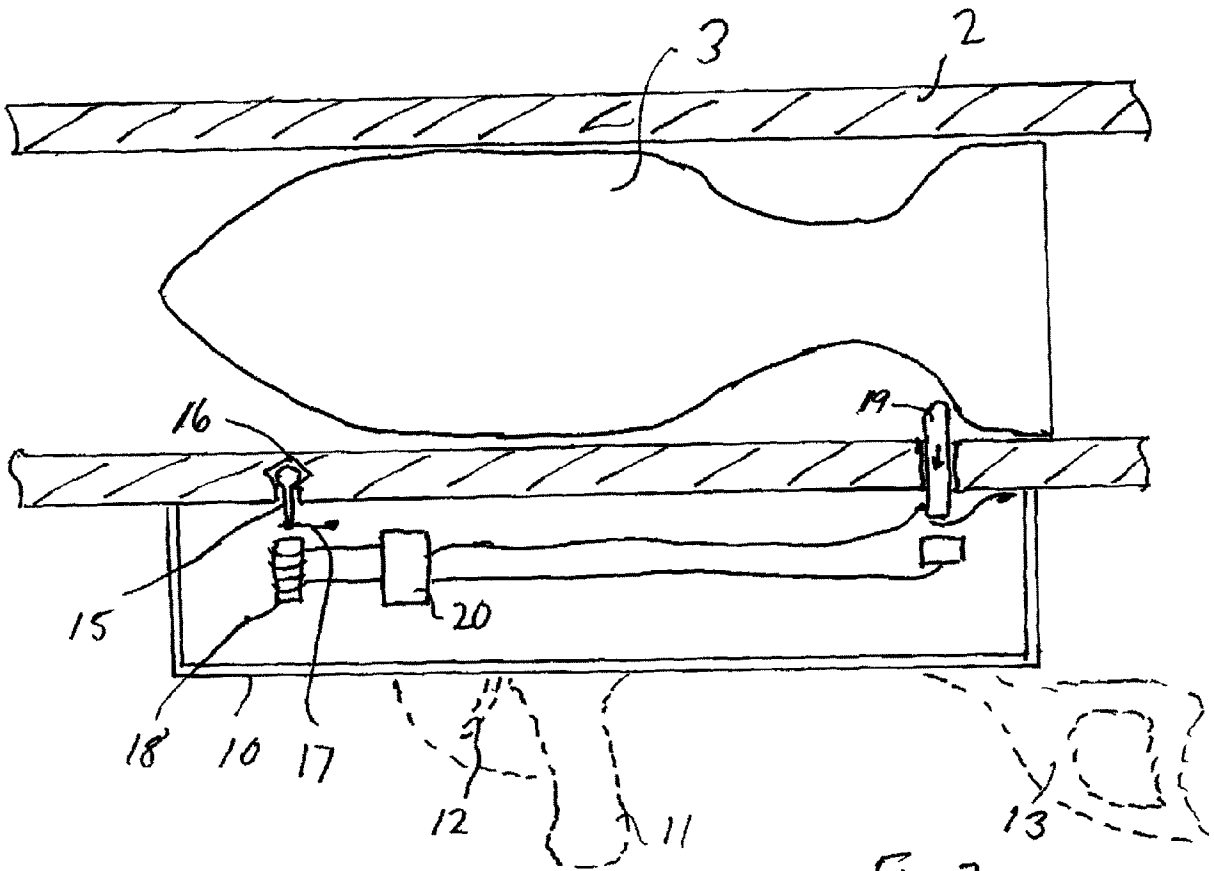
FIG. 2 schematically partly sectioned illustrates an example of a release mechanism in the countermass weapon of FIG. 1.

A releasable firing and supporting unit 10 is mounted on the launching tube 2 and comprises a handle 11 with a trigger 12, a shoulder piece 13 and a sight 14. In FIG. 2 it is exemplified how the firing and supporting unit 10 can be fixed to the launching tube 2 and released from it. In this illustrated embodiment the firing and supporting unit 10 is fixed to the launching tube 2 by snap arrangements comprising each an elongated elastic pin 15 widened in one end housed within a space 16 in the envelope of the launching tube keeping the pin in fixed position. The other end of the pin 15 is connected to an armature 17 of an electro magnet 18 located in the firing and supporting unit 10. Only one such snap arrangement has been shown in the figure. However, there are preferably a plurality of such snap arrangements provided. In such case an electro magnet can be common for several elastic pins 15. Furthermore there is a spring loaded pin 19 in contact with the shell 3 and electrically coupled to a sensor and control circuit 20.

When firing the weapon the shell 3 is pushed forwards by an increased pressure in the pressure chamber 5. This results in that the pin 19 is moved radially outwards causing an electrical connection identified by the sensor and control circuit 20 controlling an electro magnet 18. When the sensor and control circuit 20 identifies an electrical connection it activates the electro magnet 18 so that the armature 17 connected to the pin 15 is moved towards the electro magnet. In this way the firing and supporting unit 10 is released from the launching tube 2.

Figure 3:
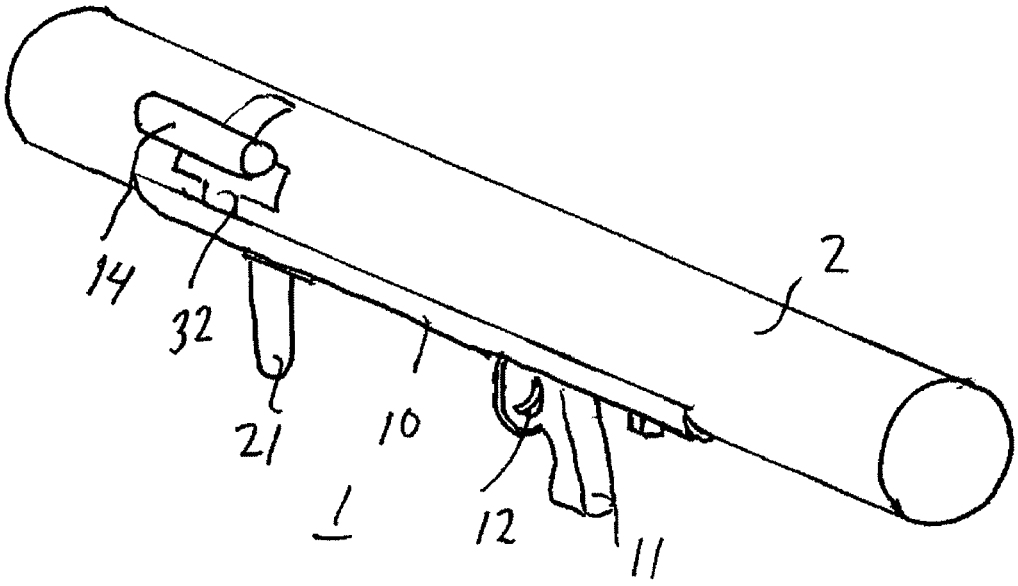
FIG. 3 schematically shows another example in perspective view of a countermass weapon according to the invention.

The countermass weapon shown in FIG. 3 has been given the same references as in FIGS. 1 and 2 for corresponding elements. Accordingly, the countermass weapon 1 comprises a launching tube 2 on which a firing and supporting unit 10 is mounted. The firing and supporting unit 10 in this case comprises a handle 11 with a trigger 12, a front piece 21 and a sight 14. A holder 32 on the firing and supporting unit 10 carries the sight 14.

Figure 4A:
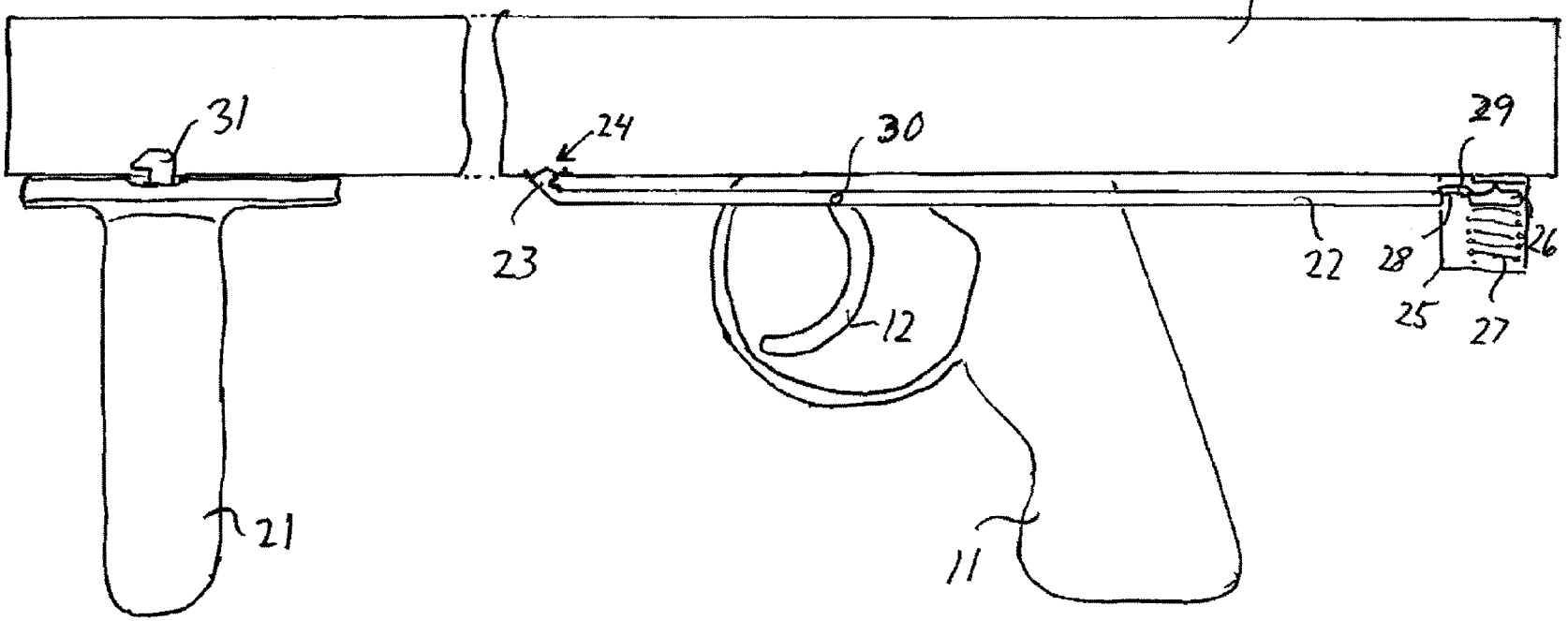
FIGS. 4*a* and 4*b* illustrate an example of a release mechanism of the countermass weapon of FIG. 3 in two different positions.
Figure 4B:
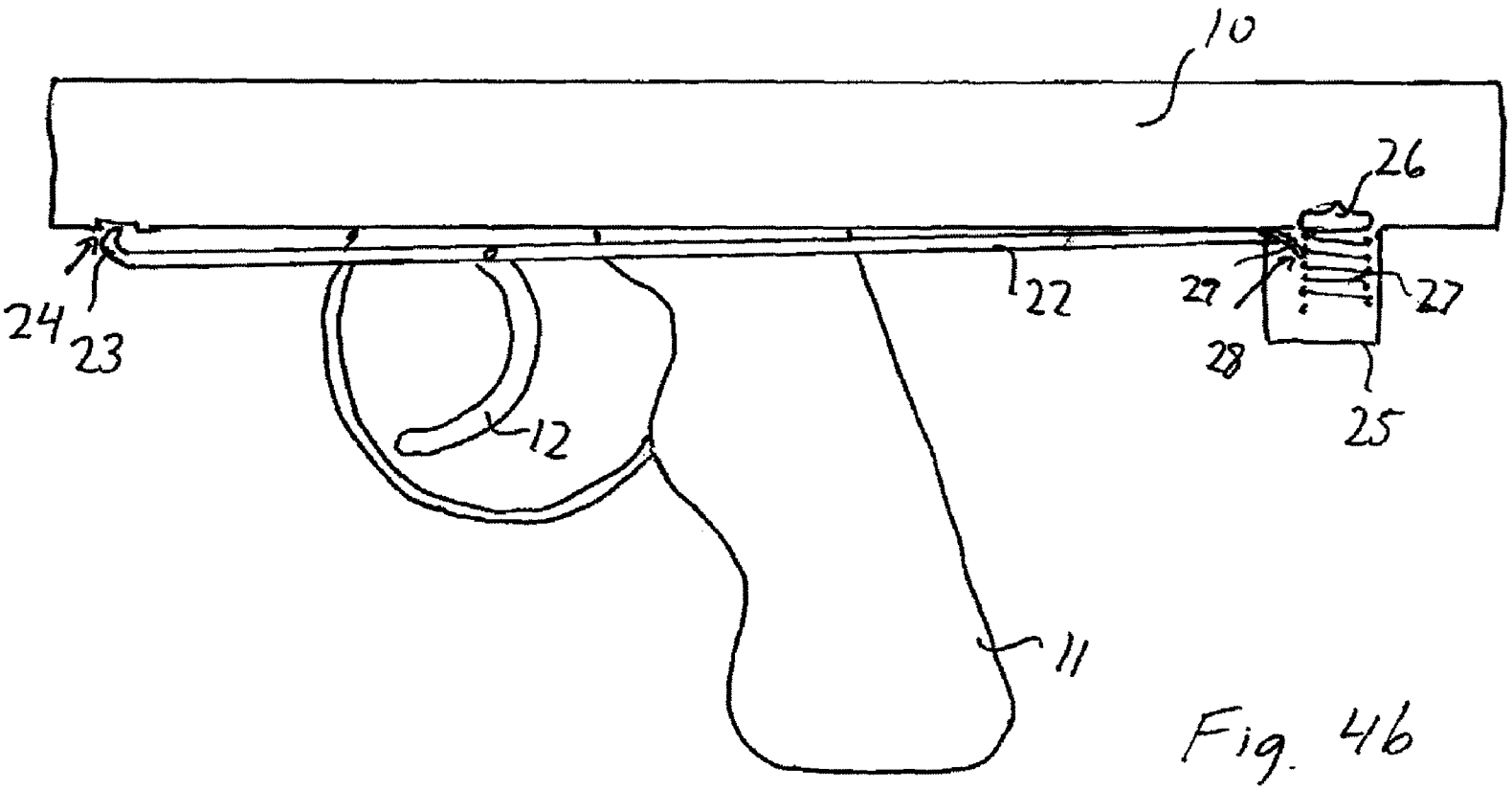

FIGS. 4*a* and 4*b* show the firing and supporting unit 10 in more detail in a position fixed to the launching tube, FIG. 4*a*, and in a position when the firing and supporting unit 10 has been released from the launching tube, FIG. 4*b*. According to FIGS. 4*a* and 4*b* there is a link arm 22 connected to a trigger 12 at the handle 11. The link arm 22 is provided with a hook 23 at the front end that can grip the launching tube through an opening 24. In the other end of the link arm 22 there is provided a firing mechanism 25 with a spring 27 loaded firing pin 26. A rocker arm 28 tiltable around an axis 29 transfers the movement of the link arm 22 to the firing mechanism to activate the firing pin 26. The link arm 22 is further arranged to be tiltable around an axis 30 where the trigger 12 is connected to the link arm 22.

The operation of the weapon described with reference to FIGS. 3, 4*a* and 4*b* is as follows. When the gunner presses the trigger 12 backwards the link arm 22 will rotate from the position shown in FIG. 4*a* to the position shown in FIG. 4*b* around the axis 30. This results in that the hook 23 will be released from the launching tube and that the firing pin 26 of the firing mechanism 25 activates the propellant charge (4 in FIG. 1). The small rotation of the link arm 22 causes the rocker arm 28 to rotate releasing the spring loaded firing pin 26. The firing and supporting unit is now released from the launching tube and the launching tube 2 can move forwards relative to the firing and supporting unit 10.

In a variant of the design of the firing and supporting unit the front piece 21 can also be provided with a release mechanism as indicated in FIG. 4*a*. In such a case there is a hook 31 gripping the launching tube 2 and that can be released by moving the front piece 21 backwards when firing. The front piece can be spring loaded forwardly by a not shown spring the force of which is overcome by the gunner when firing.

As indicated in FIG. 3 it is also possible to design the holder 32 of the sight 14 to contribute to the fastening of the firing and supporting unit 10 by folding the holder around at least a part of the launching tube 2. Such a design of the holder 32 admits the launching tube 2 to slide forwardly relative to the firing and supporting unit 10.

Figure 5A:
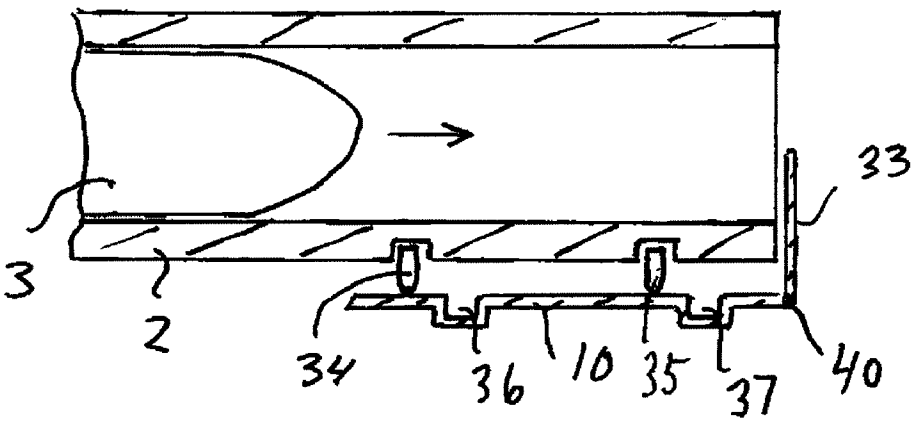
FIGS. 5*a* and 5*b* partly in section illustrate still another example of a release mechanism of a countermass weapon according to the invention based upon a mechanical disengagement of a launching tube from a firing and supporting unit.
Figure 5B:
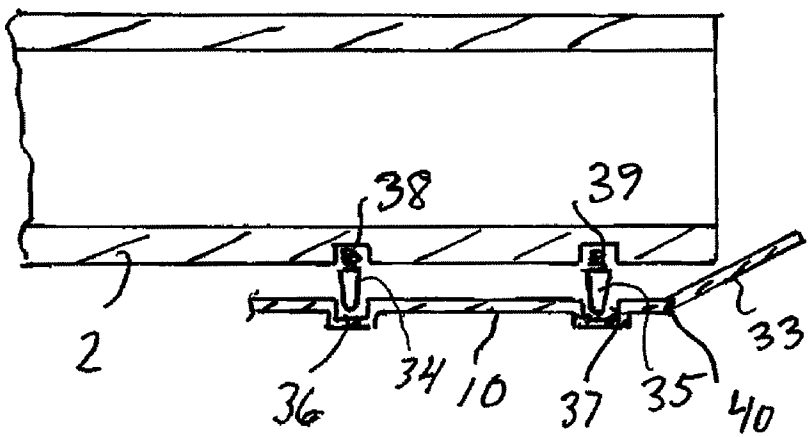

According to FIGS. 5*a* and 5*b* another example of a mechanical disengagement of the launching tube 2 from the firing an supporting unit 10 is shown. FIG. 5*a* illustrates the situation before firing showing the shell 3 in position within the launching tube 2, while FIG. 5*b* shows the situation after firing when the shell has left the launching tube 2. In this embodiment the firing and supporting unit 10 is provided with a plate 33 in front of the firing and launching unit 10. The plate 33 is fixed to the firing and supporting unit 10 in such way that it can be bent around a transition that in a simple way could be obtained by a weakening 40 in the transition between the plate 33 and the firing and supporting unit 10. The launching tube 2 is designed to slide relative to the firing and supporting unit 10 under the control of plate 33 and spring loaded pins 34 and 35 arranged at the surface of the launching unit and to cooperate with recesses 36 and 37 in the firing and supporting unit 10. Each pin 34 and 35 is allocated a spring 38 and 39, respectively.

In operation a back pressure from the shell 3 acts on the plate 33 resulting in that the plate 33 is moved to the position shown in FIG. 5*b*. This movement unblocks the launching tube 2 so that the launching tube 2 under the influence of a forward directed recoil of the launching tube is moved forward relative to the firing and supporting unit 10. During this relative movement the spring loaded pins are pushed into the recesses 36 and 37 by the springs 38 and 39 making the launching tube 2 still more loosely fit to the firing and supporting unit 10.

The embodiment described above refers to a countermass weapon comprising a shell. It is however easy and within the scope of the invention to modify the weapon for other types of launchable units.

The invention claimed is:

1. A countermass weapon, comprising:

a launching tube open or openable in both ends, the launching tube housing a launchable unit, a countermass, a pressure chamber, a propellant charge that upon firing and combustion of the charge in cooperation with the pressure chamber and the countermass accelerates the launchable unit forwards in the tube at the same time as the countermass accelerates backwards in the tube, and a firing and supporting unit connected to the outside of the launching tube, wherein the countermass is designed such that a forward directed recoil is obtained and wherein the launching tube is designed to be disengageable from the firing and supporting unit during the forward directed recoil, and wherein the launching tube is disengageable by an electro mechanical connection between the launching tube and the firing and supporting unit.

2. The countermass weapon according to claim 1, wherein the countermass comprises indications of fractions on the surface of the countermass to obtain a forward directed recoil.

3. The countermass weapon according to claim 1, wherein the movement of the firing pin comprised in the firing and supporting unit initiates the disengagement of the launching tube.

4. The countermass weapon according to claim 1, wherein a link arm coupled to the trigger of the firing and supporting unit initiates the disengagement of the launching tube.

5. The countermass weapon according to claim 1, wherein a spring-pin arrangement influenced by the movement or ignition of the launchable unit is provided to initiate the disengagement of the launching tube.

6. The countermass weapon according to claim 1, wherein the firing and supporting unit comprises a shoulder piece.

7. The countermass weapon according to claim 1, wherein the firing and supporting unit comprises a front piece.

8. The countermass weapon according to claim 7, wherein the front piece is provided with a hook releasable from the launching tube by a movement backwards.

9. The countermass weapon according to claim 1, wherein the firing and supporting unit comprises a sighting device.

10. The countermass weapon according to claim 9, wherein the sight comprises a holder designed to be folded at least partly around the launching tube.

11. The countermass weapon according to claim 1, wherein the firing and supporting unit is designed re-usable for enabling connection to a plurality of different launchable units.

12. A countermass weapon, comprising:

a launching tube open or openable in both ends, the launching tube housing a launchable unit, a countermass, a pressure chamber, a propellant charge that upon firing and combustion of the charge in cooperation with the pressure chamber and the countermass accelerates the launchable unit forwards in the tube at the same time as the countermass accelerates backwards in the tube, and a firing and supporting unit connected to the outside of the launching tube, wherein the countermass is designed such that a forward directed recoil is obtained and wherein the launching tube is designed to be disengageable from the firing and supporting unit during the forward directed recoil, and wherein the launching tube is disengageable by a magnetic connection between the launching tube and the firing and supporting unit.

13. The countermass weapon according to claim 12, wherein the countermass comprises indications of fractions on the surface of the countermass to obtain a forward directed recoil.

14. The countermass weapon according to claim 12, wherein a spring-pin arrangement influenced by the movement or ignition of the launchable unit is provided to initiate the disengagement of the launching tube.

15. The countermass weapon according to claim 12, wherein the firing and supporting unit comprises a shoulder piece.

16. The countermass weapon according to claim 12, wherein the firing and supporting unit comprises a front piece.

17. The countermass weapon according to claim 12, wherein the firing and supporting unit is designed re-usable for enabling connection to a plurality of different launchable units.

18. The countermass weapon according to claim 12, wherein the firing and supporting unit comprises a sighting device.

19. The countermass weapon according to claim 18, wherein the sight comprises a holder designed to be folded at least partly around the launching tube.

* * * * *